US010683877B2

(12) United States Patent
Palmisano

(10) Patent No.: US 10,683,877 B2
(45) Date of Patent: Jun. 16, 2020

(54) STATIC BILGE PUMP

(71) Applicant: Doug Palmisano, Pompano Beach, FL (US)

(72) Inventor: Doug Palmisano, Pompano Beach, FL (US)

( * ) Notice: Subject to any disclaimer, the term of this patent is extended or adjusted under 35 U.S.C. 154(b) by 217 days.

(21) Appl. No.: 15/691,740

(22) Filed: Aug. 30, 2017

(65) Prior Publication Data

US 2018/0022421 A1 Jan. 25, 2018

Related U.S. Application Data

(63) Continuation-in-part of application No. 15/465,527, filed on Mar. 21, 2017, which is a continuation-in-part of application No. 14/316,730, filed on Jun. 26, 2014, now Pat. No. 9,598,146.

(60) Provisional application No. 61/839,847, filed on Jun. 26, 2013.

(51) Int. Cl.

| | |
|---|---|
| ***F04F 1/10*** | (2006.01) |
| ***F04F 1/18*** | (2006.01) |
| ***F04F 5/10*** | (2006.01) |
| ***F04F 5/46*** | (2006.01) |
| ***F04F 5/54*** | (2006.01) |
| ***F04F 1/06*** | (2006.01) |
| ***B63B 13/00*** | (2006.01) |

(52) U.S. Cl.

CPC ..... *F04F 1/10* (2013.01); *B63B 13/00* (2013.01); *F04F 1/18* (2013.01); *F04F 5/10* (2013.01); *F04F 5/466* (2013.01); *F04F 5/54* (2013.01); *F04F 1/06* (2013.01)

(58) Field of Classification Search

CPC ..... F04F 1/06; F04F 1/18; F04F 5/10; F04F 5/46; F04F 1/10; F04F 1/12; B63B 13/00; B63B 13/02; B63H 21/38

USPC ..... 114/185, 183 R, 184; 417/151, 158, 179, 417/232

See application file for complete search history.

(56) References Cited

U.S. PATENT DOCUMENTS 322,374 A * 7/1885 Haydn ..... B63B 13/00 114/185
349,497 A * 9/1886 Haydn ..... B63B 13/00 114/185
1,578,621 A * 3/1926 Wood ..... B63B 13/00 114/185

(Continued)

*Primary Examiner* — Alexander B Comley
(74) *Attorney, Agent, or Firm* — Allen F Bennett; Bennett Intellectual Property

(57) ABSTRACT

A static bilge pump has a body surrounded by a shell, forming a motive plenum therebetween. Inlets in the front of the shell allow a motive fluid to enter the motive plenum. The motive plenum tapers, decreasing in cross-sectional area along with width as it moves toward its aft, and ends at a motive nozzle. The body houses a suction chamber in fluid communication with a suction inlet that is in fluid communication with the bilge of a boat. Ejectors are positioned proximal to and between the motive nozzle and the discharge outlet. When the static bilge pump is exposed to fluid flow from its front to its stern, such as when a boat is in motion, water enters the motive inlets, filling the motive Plenum and acting as a motive fluid. The motive fluid is ejected at high pressure from the motive nozzle, creating suction at the ejectors and discharging the motive fluid as well as liquid with in the suction chamber out the discharge outlet.

1 Claim, 14 Drawing Sheets

(56) References Cited

U.S. PATENT DOCUMENTS 1,769,136 A 12/1928 Hepburn
2,023,586 A 2/1933 Harrod
2,018,687 A 3/1934 Sims
2,120,858 A * 6/1938 Davant ..... B63B 13/00 114/185
2,138,368 A * 11/1938 Briant ..... B63B 13/00 114/185
2,138,369 A * 11/1938 Briant ..... B63B 13/00 114/185
2,404,202 A * 7/1946 Winslow ..... B63B 13/00 114/184
2,418,252 A * 4/1947 Engle ..... B63B 13/00 114/185
2,444,615 A * 7/1948 Reinhardt ..... B63B 13/00 417/170
2,479,783 A * 8/1949 Sawyer ..... B63B 13/00 114/185
2,551,497 A * 5/1951 Lee ..... B63B 13/00 114/185
2,608,160 A * 8/1952 Moody ..... F04F 5/46 114/185
2,672,113 A * 3/1954 McCartney ..... B63B 13/00 114/185
2,834,312 A * 5/1958 Baxter ..... B63B 13/00 114/185
2,866,431 A * 12/1958 Conover ..... B63B 13/00 114/185
3,180,301 A * 4/1965 Keller ..... B63B 13/00 114/185
3,460,503 A * 8/1969 Chalmers ..... B63B 13/00 114/185
3,572,280 A * 3/1971 Monson ..... B63B 13/00 114/184
4,595,372 A * 6/1986 Hebert ..... B63H 20/36 114/185
4,667,616 A * 5/1987 Mahon ..... B63B 13/00 114/183 R
4,850,908 A * 7/1989 Nakase ..... B63B 13/00 440/39
4,913,075 A * 4/1990 Rohr, Jr. ..... B63B 13/00 114/185
6,663,451 B1 12/2003 Walczak
6,951,312 B2 10/2005 Casalmir et al.
2017/0191504 A1* 7/2017 Palmisano ..... F04F 1/06

* cited by examiner

Fig. 15
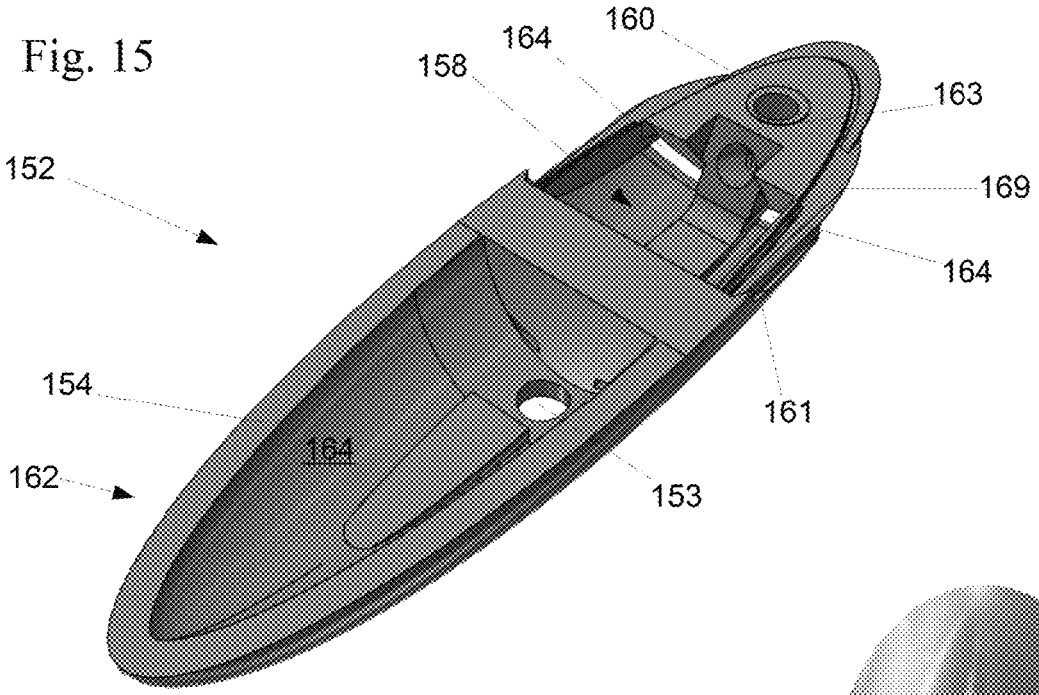
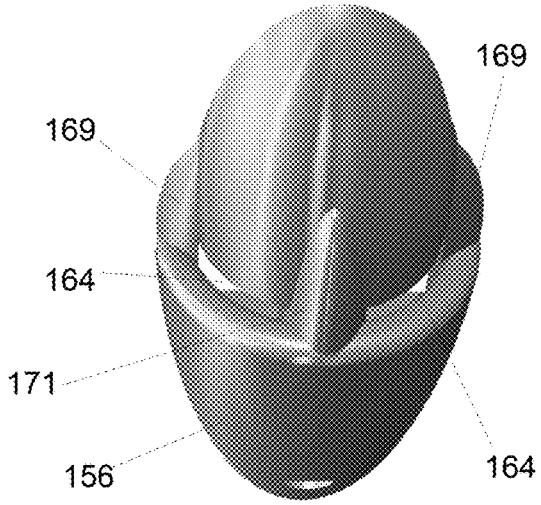
Fig. 16
Fig. 17
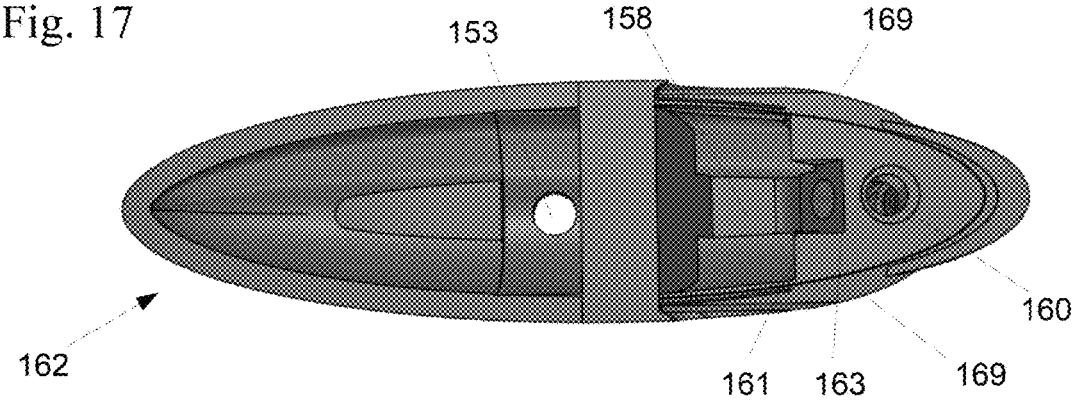

Fig. 18
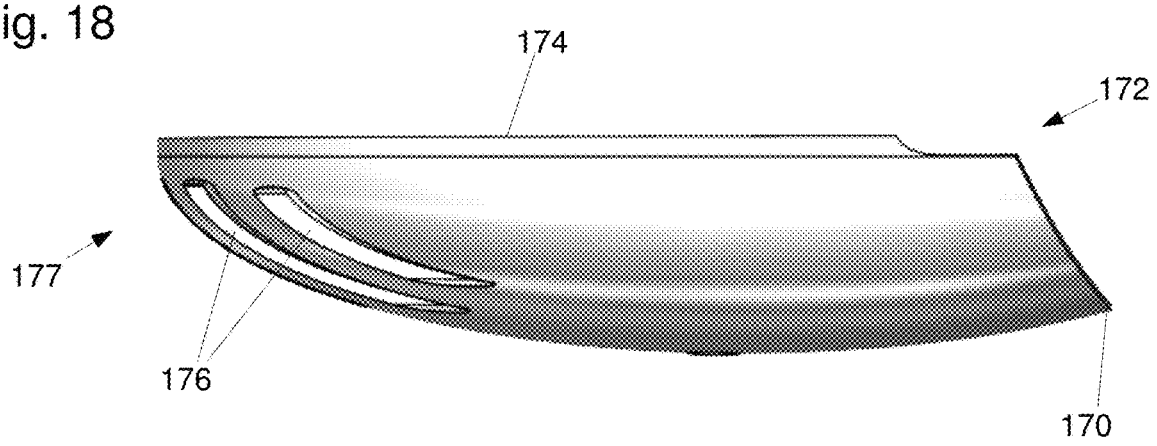
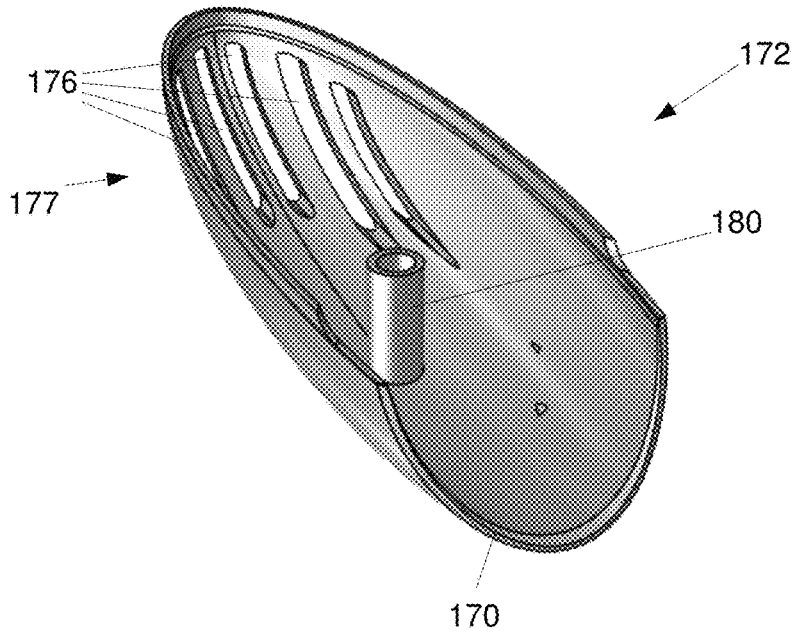
Fig. 19
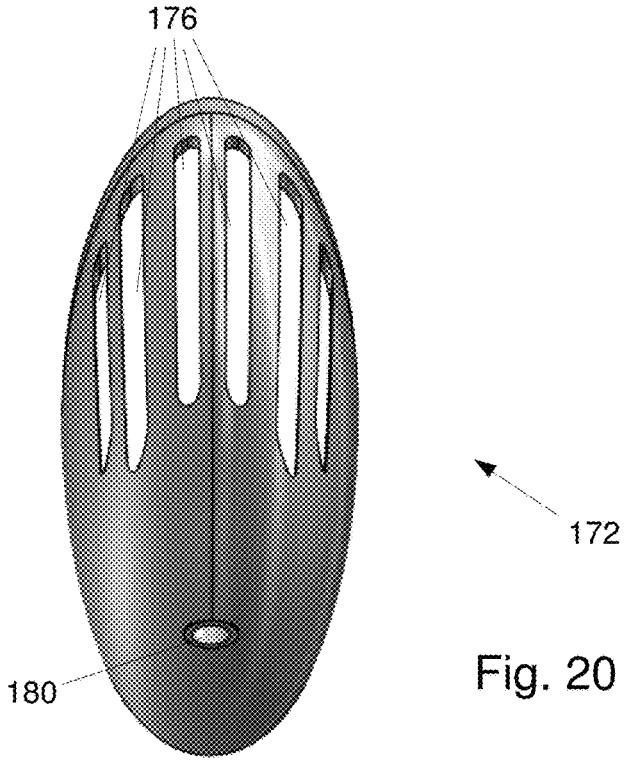
Fig. 20

STATIC BILGE PUMP

CROSS-REFERENCE TO RELATED APPLICATIONS

This application is a continuation-in-part of U.S. patent application Ser. No. 15/465,527 filed on Mar. 21, 2017, and a continuation-in-part of U.S. patent application Ser. No. 14/316,730 filed on Jun. 26, 2014, which issued on Mar. 21, 2017 as U.S. Pat. No. 9,598,146. This application claims priority to U.S. Provisional Application Ser. No. 61/839,847 filed on Jun. 26, 2013, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

BACKGROUND OF THE INVENTION

Field of Endeavor

The present invention relates to systems and devices for draining the bilge of a vessel in a body of water. More particularly, the invention relates to systems and devices having no moving parts and which may be used to drain a boat bilge.

Background Information

Since boats were first built, water collecting in the bilge, or the bottom of the interior of the hull, has been a problem. Numerous methods of been developed to remove bilge water from a boat. Automatic drains have been developed which open while a boat is in motion, allowing water to drain out. When the boat comes to a stop, the drain closes. However, because even when a boat is at rest, it is still subject to wind, current and other forces, such automatic drains often do not remain completely closed while a boat is at rest.

Another difficulty encountered with automatic drains is that they typically include components exterior to the hull. Prior to the advent of powered boats, this did not present a significant problem. However, many boats today are designed to operate at high speed. The hulls of most boats are streamlined to minimize water resistance and drag. Pumps, which include bulky devices on the exterior of the hull are thus not desirable.

Most boats today come with an automatic bilge pump. While these pumps are typically effective, they generally consist of an electric motor and some sort of pump mechanism. Because many boats are subjected to harsh conditions, it is not unusual for a bilge pump to become damaged or to cease functioning. Bilge pumps may require maintenance and may be inefficient. Further, pumping mechanisms generally require seals, rings, or other components made of rubber or other pliable substance. These substances often wear out when subjected to salt water. This further complicates maintenance of the system's.

In view of the foregoing, there is a need to provide a device and system for draining the bilge of a boat. It is therefore desirable to provide a device and system for draining the bilge of a boat that requires little maintenance, does not increase drag substantially, and is efficient.

BRIEF SUMMARY OF THE INVENTION

Accordingly, the primary object of the present invention is to provide a static bilge pump.

In greater detail, the invention provides a bilge pump having no moving parts and which removes water from the bilge without any application of force or energy. In one embodiment, a static bilge pump comprises an inlet tube, a body and at least one eductor.

In another embodiment the static bilge pump further comprises one or more of an inlet tube having an inlet duct and a drain conduit extending to a drain plug, a body having a frame and a conduit in fluid communication with the inlet duct, an eductor having a buttress, an eductor inlet in fluid communication with the conduit of the body, a nozzle in communication with an aperture, an annular vacuum chamber, an eduction chamber and an exhaust, a siphon hose attached to the inlet tube, plugs providing access to one or more of a drain, a conduit in the body, and an induction inlet.

In a further embodiment, the static bilge pump is attached to the stern of a boat.

In another embodiment a static bilge pump comprises an inlet tube housing a pump conduit and a drainage conduit, a body housing an internal conduit in fluid communication with the pump conduit, and at least one eductor in fluid communication with the internal conduit in the body. The static bilge pump is capable of being attached to the exterior of a boat hull and it removes water from a bilge of a boat when the boat is moving forward. The drainage conduit provides fluid communication between an aperture on the side of the inlet tube and a drainage outlet on the body, and is not in fluid communication with the pump conduit. The pump may have a plurality of eductors, and the body may have a frame. A siphon hose may be removably attached to the inlet tube.

In another embodiment, the static bilge pump may have one or more eductors comprising an eductor housing having an eduction chamber, an intake aperture, an intake nozzle providing fluid communication between the eduction chamber and the intake aperture, an eductor inlet providing fluid communication between an eduction port and the internal conduit, an annular vacuum chamber in fluid communication with the eductor port and eduction chamber and an exhaust port.

In another embodiment, the eductor housing is cylindrical, the intake aperture includes a screen to prevent debris from entering the eductor housing, and/or the body further has an internal frame. A siphon hose is removably attached to the inlet tube.

In another embodiment, the static bilge pump of claim 6 wherein the drainage conduit provides fluid communication between an aperture on the side of the inlet tube and a drainage outlet on the body, and is not in fluid communication with the pump conduit.

In another embodiment, a static bilge pump has an inlet tube housing a pump conduit and a drainage conduit, a body having a frame and housing an internal conduit in fluid communication with the pump conduit, and at least one eductor in fluid communication with the internal conduit in the body. The static bilge pump is capable of being attached to the exterior of a boat hull and removes water from a bilge of a boat when the boat is moving forward. The drainage conduit provides fluid communication between an aperture on the side of the inlet tube and a drainage outlet on the body, and is not in fluid communication with the pump conduit. The eductor comprises a cylindrical eductor housing having an eduction chamber, an intake aperture having a screen to prevent entry of debris, an intake nozzle providing fluid communication between the eduction chamber and the intake aperture, an eductor inlet providing fluid communication between an eduction port and the internal conduit, an annular vacuum chamber in fluid communication with the eductor port and eduction chamber and an exhaust port.

It is therefore an object of the present invention to provide a static bilge pump having no moving parts and which may be easily integrated with existing boat hulls.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 15 is a top perspective view of a body of another alternative embodiment of a static bilge pump in accordance with the principles of the invention;

FIG. 16 is a bottom perspective view of a body of another alternative embodiment of a static bilge pump in accordance with principles of the invention;

FIG. 17 is a top plan view of a body of another alternative embodiment of a static bilge pump in accordance with the principles of the invention;

FIG. 18 is a side elevation view of a shell of another alternative embodiment of a static bilge pump in accordance with the principles of the invention;

FIG. 19 is a perspective view of a shell of another alternative embodiment of a static bilge pump in accordance with the principles of the invention;

FIG. 20 is a front perspective view of a shell of another alternative embodiment of a static bilge pump and accordance with principles of the invention;

DETAILED DESCRIPTION

Figure 1:
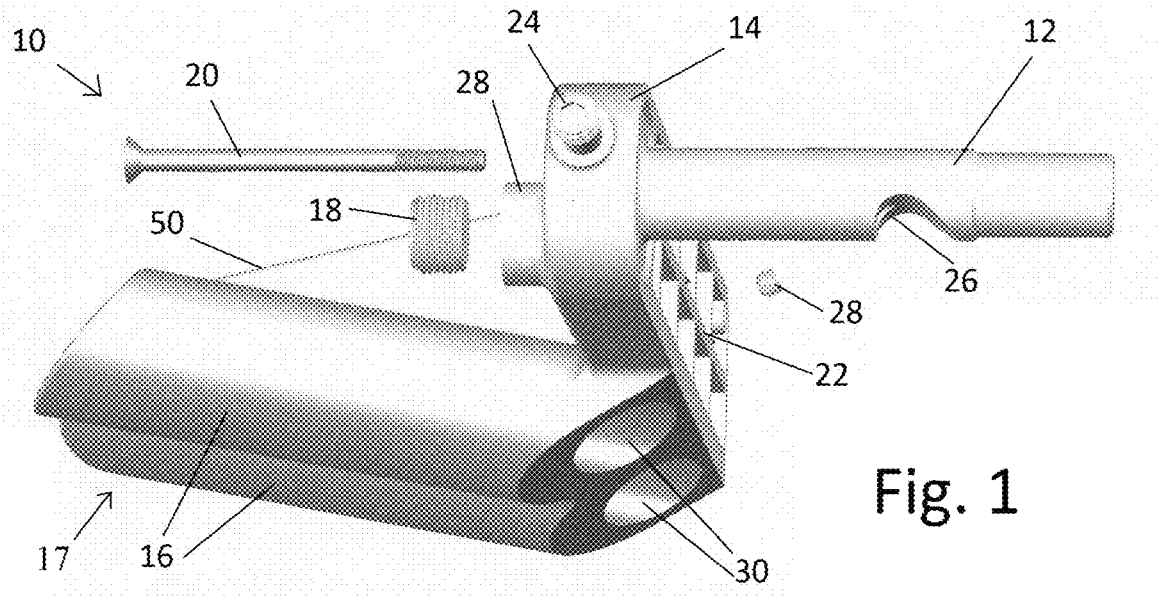
FIG. 1 is a perspective view of a static bilge pump in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Disclosed is a static bilge pump for watercraft requiring no moving parts. The static bilge pump may be attached to the hull over the drain hole commonly found at the hack of the boat adjacent to the lowest point of the bilge. The static bilge pump may remove water from the bilge of a boat. When the boat is not submerged, the boat's original drain may still be utilized.

In the following description, the term "distal" generally refers to a direction away from a boat to which the static bilge pump is attached, and the term "proximal" generally refers to a direction toward the boat. Thus, "distal" could optionally be considered "back" or "rear" and "proximal" could optionally be considered "forward" or "front." "Longitudinal" generally refers to a direction from the front to the back of an object. "Transverse" and/or "lateral" generally refers to the left and right sides of an object, as opposed to "longitudinal."

Figure 2:
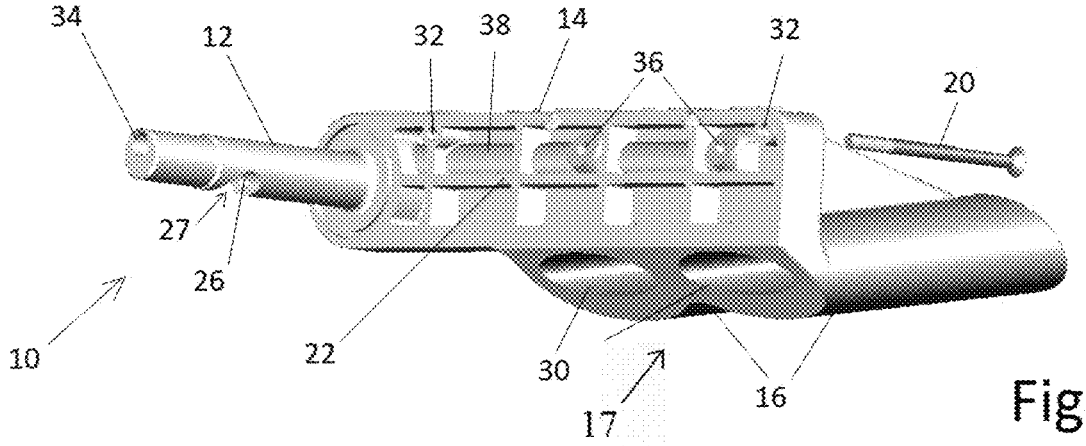
FIG. 2 is another perspective view of a static bilge pump in accordance with the principles of the invention.
Figure 3:
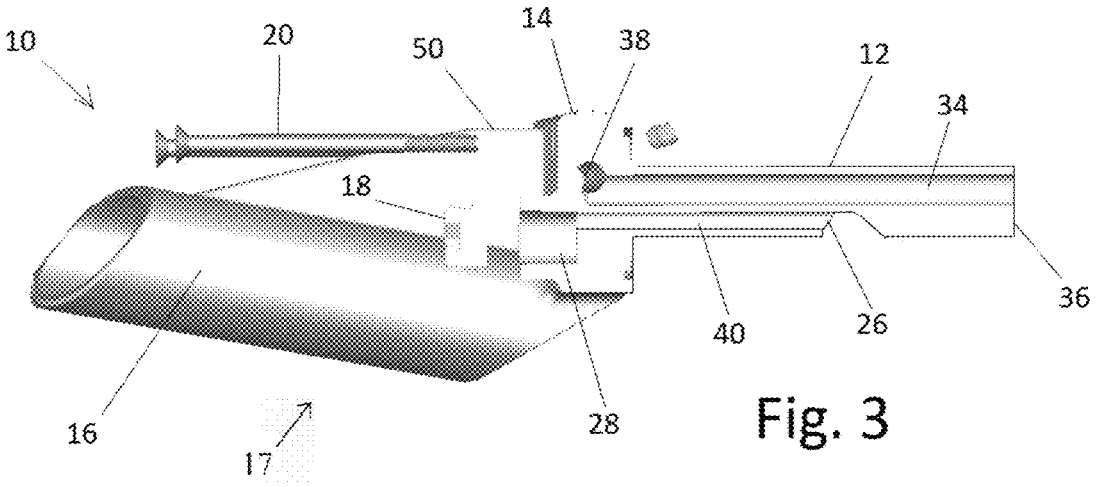
FIG. 3 is a lateral cross-sectional view of an inlet tube of a static bilge pump in accordance with the principles of the invention.

Referring to FIGS. 1-6, the static bilge pump 10 may include an inlet tube 12, a body 14 and one or more eductors 17. The inlet tube 12 may house a drainage conduit 40 and a pump conduit 34, as shown in FIG. 3, that are not in fluid communication with each other. The drainage conduit 40 may extend from the drain aperture 26 to the drainage outlet 28. Drainage outlet 28 may be located on the distal end of the body 14 as shown in FIG. 1, or may optionally be located on the side of the body 14. Drainage outlet 28 may be scaled by inserting a drain plug 18. Fluid communication between the drain aperture 26 and the drainage outlet 28 may allow a boat to be drained while out of the water, in the same manner used in the absence of an attached static bilge pump. When a boat is in the water, it may be preferable to have the drain plug inserted into the drainage outlet.

An attachment mechanism may be used to affix the static bilge pump 10 to a boat's hull. In the embodiment shown in FIGS. 1-6, the attachment mechanism comprises a bolt 20 and bolt holes 32. Other attachment mechanisms suitable for attaching devices to the exterior of a boat hull may be used. For example, the inlet tube 12 may include an annular sleeve that may be inserted about the portion of the inlet tube that extends into the interior of the boat hull.

In this embodiment, the body 14 includes an interior frame 22 to provide strength and rigidity to the body 14. The body 14 may optionally be formed as a solid block. The body 14 may house an internal conduit 38 in fluid communication with the pump conduit 34 and the eductor inlets 46. In this embodiment, a conduit plug 24 may provide access to the internal conduit 38 which may be desirable for inspection, repair and/or manufacturing. Other plugs, for example inlet plugs 26 may also provide access to the internal conduit 38 and facilitate inspection, repair, cleaning and/or manufacturing.

In FIG. 2 conduit 38, bolt holes 32, suction duct 34 and nozzle access ports 36 may be seen. Drain aperture 26 may be located within a recess 27 on the side of the inlet tube 12. The opening to suction duct 34 may be located on the proximal end of inlet tube 12 and may be designed to accommodate removable fluid connection with a hose, pipe, tube or other device for moving fluids.

FIG. 3 shows a lateral cross-section of the inlet tube 12 of the static bilge pump 10. Within inlet tube 12, a drainage conduit 40 extends from the drainage aperture 26 to the drain 28, which may be sealed using drain plug 18. Suction conduit 34 extends the length of inlet tube 12 from the proximal end 36 to the internal conduit 38. Thus, pump conduit 34 provides fluid communication from the proximal end 36 of the inlet tube 12 to the internal conduit 38. The pump conduit 34 and the drainage conduit 40 may not be in fluid communication with each other. However, in some alternative embodiments, it may be desirable to optionally provide fluid communication between these or other conduits or valves for adjusting fluid communication between the various conduits.

Figure 4:
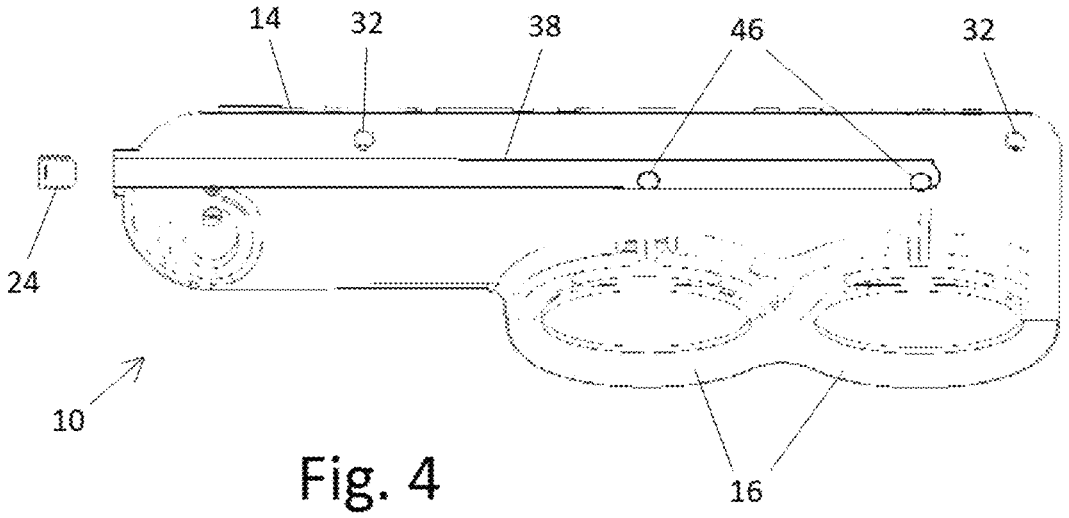
FIG. 4 is a transverse cross-sectional view of a body of a static bilge pump in accordance with the principles of the invention.

FIG. 4 shows a transverse cross-section of the body 14 of the static bilge pump 10. The body 14 includes the internal conduit 38 housed inside the body. The conduit plug 24 seals the end of the internal conduit 38 and also allows access to the conduit 38 from the exterior of the body 14. Bolt holes 32 may extend through body 14. As shown in FIG. 3, conduit 38 is in fluid communication with the suction duct 34. Conduit 38 is also in fluid communication with eductor inlets 46.

Figure 5:
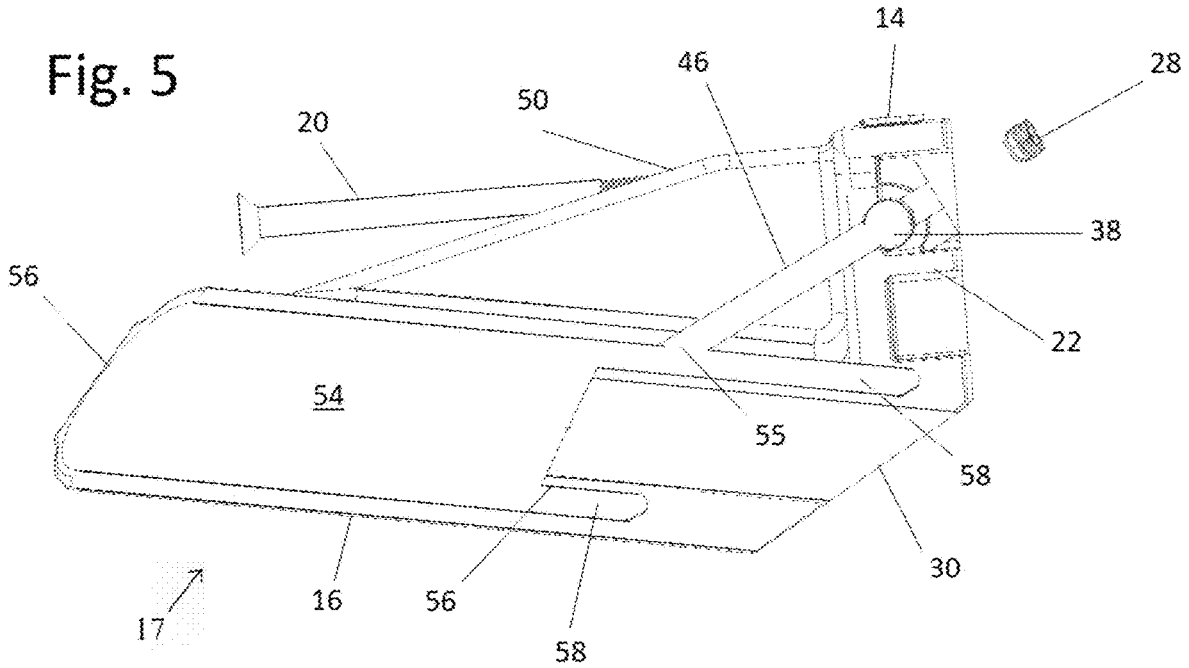
FIG. 5 is a lateral cross-sectional view showing the interior of an eductor of a static bilge pump in accordance with the principles of the invention.

Referring now to FIG. 5, a lateral cross-section of the static bilge pump 10 shows the interior of an eductor 17 and the body 14. Internal conduit 38 is in fluid communication with the eductor inlet 46. Plug 28 may be removed from the body 14 to access the interior of eductor inlet 46.

The eductor 17 may include several components. In this embodiment, the eductors include a cylindrical body housing the components of the eductor 17. The eductor inlet 46 may be in fluid communication with an annular vacuum chamber 58 by means of eduction port 55. Eduction inlet 46 may be integral to buttress 50. Buttress 50 extends from the body 14 to provide additional rigidity and support to the static bilge pump 10 and may be optional. The annular vacuum chamber 58 may surround a cylindrical motive nozzle 56, which may in fluid communication with intake aperture 30. When a boat is in motion, water may enter intake aperture 30 and enter eduction chamber 54 through intake nozzle 56. Water introduced into eduction chamber 54 through nozzle 56 creates a vacuum, courtesy of Bernoulli's Principle, within annular vacuum chamber 58. This creates suction at induction port 55. The suction, or negative pressure, applied to induction port 55 provides suction through eductor inlet 46, conduit 38 and pump conduit 34. Water and other items in eduction chamber 54 exit through exhaust port 56.

Figure 6:
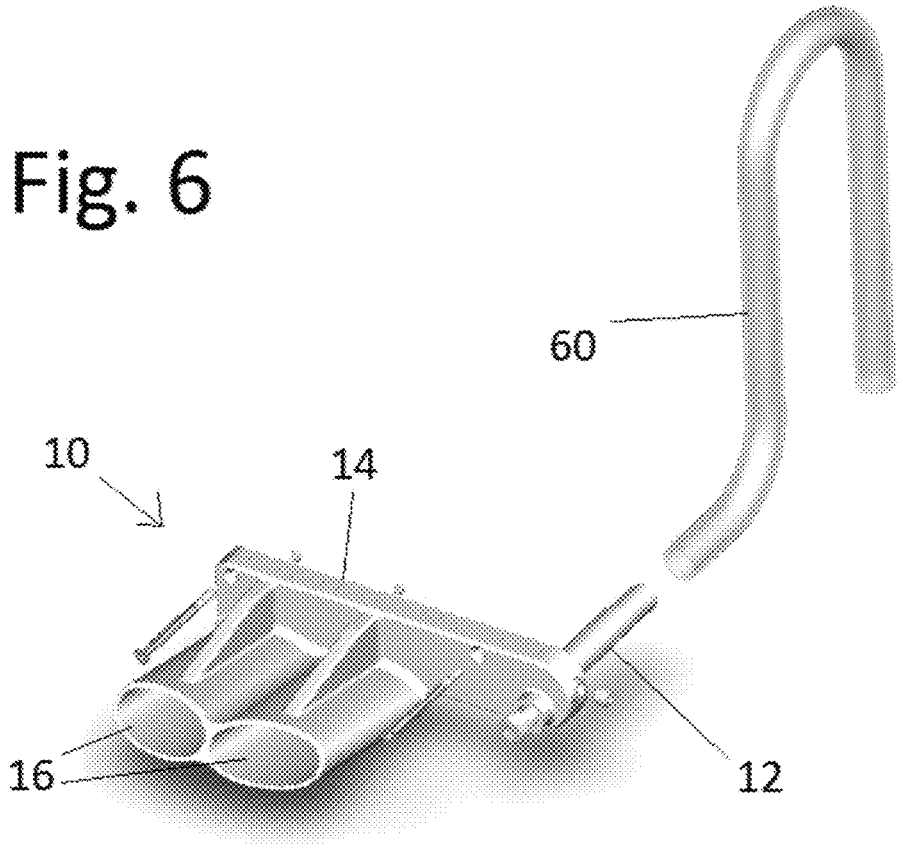
FIG. 6 is a perspective view of a static bilge pump with a siphon hose in accordance with the principles of the invention.

FIG. 6 shows the static bilge pump 10 with a siphon tube 60. The static bilge pump 10 may be placed on the exterior of a boat such that inlet tube 12 extends through a boats drain hole. Alternatively, a separate hole may be made in the hull of a boat through which the inlet tube may be extended. Body 14 may then be affixed to the exterior of the hull such that the front apertures of the eductors 16 are exposed to oncoming water when the boat is in motion. The inlet to 12 may then be attached to siphon 60. When in use, when a boat is traveling, the eductors 16 create vacuum suction which travels through the eductor inlets, the conduits and the inlet duct through siphon 60. The end 62 of siphon to 60 may be placed at or near the bottom of the bilge. Alternatively, siphon 60 may be flexible such that the end 62 of siphon 60 may be used as a vacuum hose such that a person in the boat may move the end 62 about to suck up and remove bilge water wherever it is located. The arched, "upside-down U" characteristic shape of the siphon 60 may prevent water from entering a bilge while the boat is at rest or in reverse.

Figure 7:
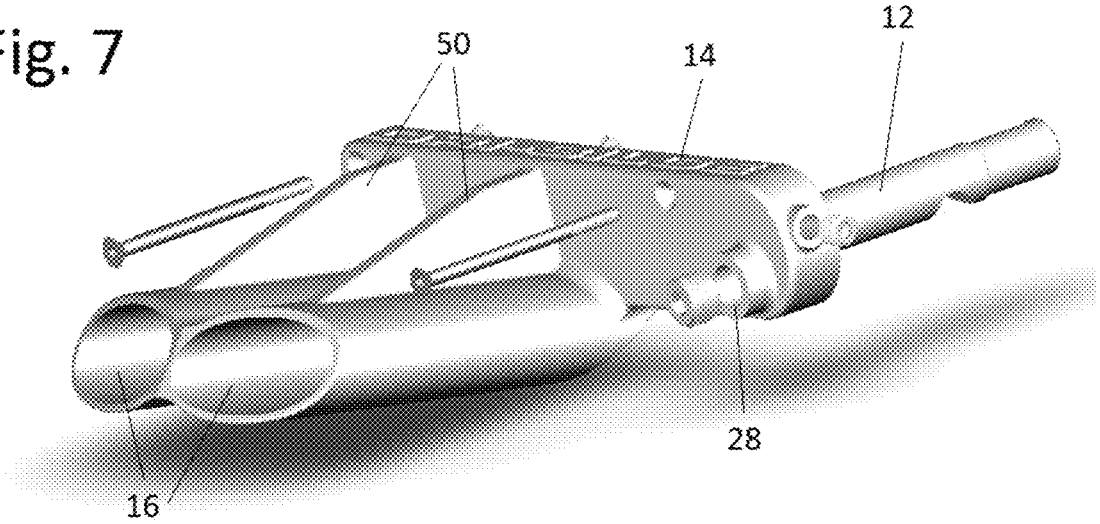
FIG. 7 is a perspective view of a static bilge pump in accordance with the principles of the invention.
Figure 8:
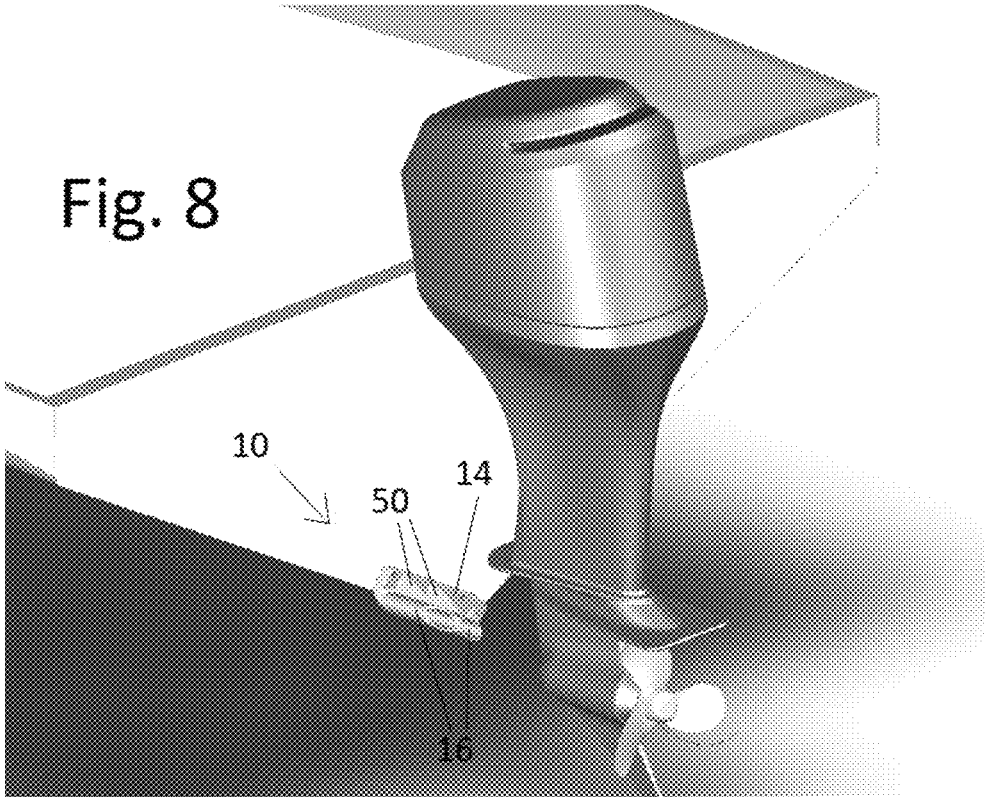
FIG. 8 is an environmental view of a static bilge pump with a siphon hose in accordance with the principles of the invention.

FIG. 7 shows a perspective view of the static bilge pump 10. The static bilge pump 10 may be attached to the stern of a boat but may also be attached to other objects. For example, a static bilge pump in accordance with the principles of the invention may include fins or other devices to facilitate proper orientation when dragged through water. Such an embodiment may be attached to the end of a hose and dragged by a boat. The motion through the water will generate suction and may provide an emergency back up alternative bilge pump for boats. The exhaust ports 56 of the eductors 17 may be swept back or swept together for hydrodynamic and/or aesthetic purposes. FIG. 8 shows a static bilge pump attached to the stern of a boat. In this Figure, the static pump is retrofit to a boat through its drain hole. The pump may have a very low profile, not significantly increasing drag.

Static bilge pump 10 may include two eductors 17 housed in cylindrical eductor bodies 16. It may be desirable to optionally utilize one eductor or 3 or more eductors, each having its own housing, which may be cylindrical or optionally parallelepiped or other shape. As shown in the Figures, the forward end of the inductors 17 are angled. This swept back design may minimize drag created by the eductor's and may also minimize the possibility of flotsam and jetsam lodging in and obstructing the apertures 30. The eductor's 17 may be made larger or smaller and may have a front end that is not swept back. It may also be desirable to provide simpler eductors having a smaller body or having no housing at all. Optionally, the inlet apertures of the eductors may include a grate or screen to prevent debris from entering the eductor housings.

Buttresses 50 extending between the body and the eductor housings 16 may provide additional stability to the static bilge pump 10. They also may house the induction inlets. It may be desirable to include additional buttresses or to use none at all. The inlet tube 12 of the invention incorporates both atypical drain as well as and inlet duct for the static bilge pump 10. It may be desirable to not include the simple drain aspects of the inlet tube 12.

Figure 9:
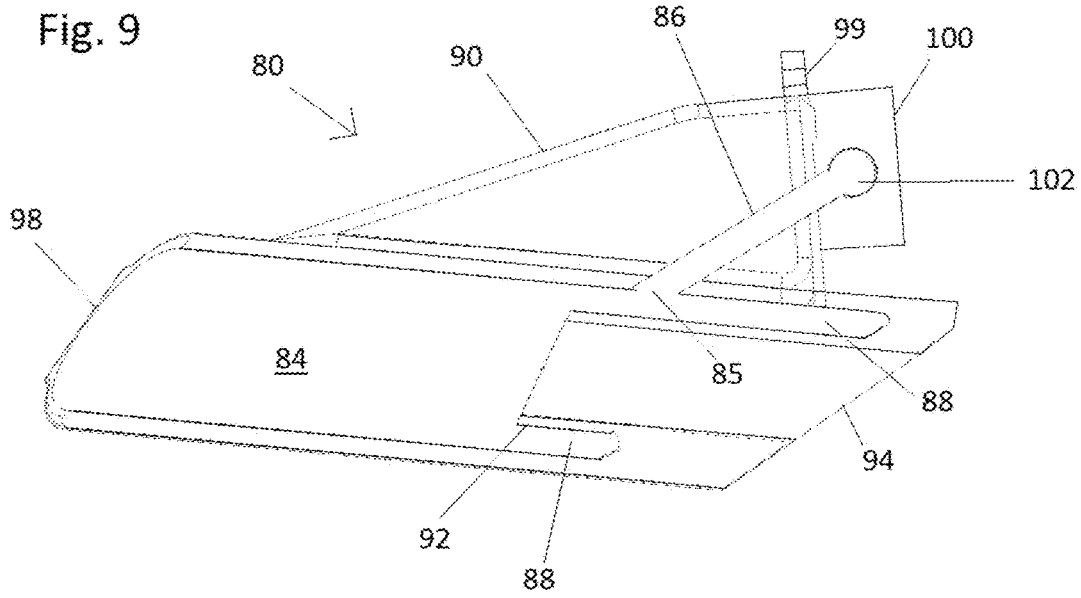
FIG. 9 is a lateral cross-sectional view of an alternative embodiment of an eductor of a static bilge pump in accordance with the principles of the invention.
Figure 10:
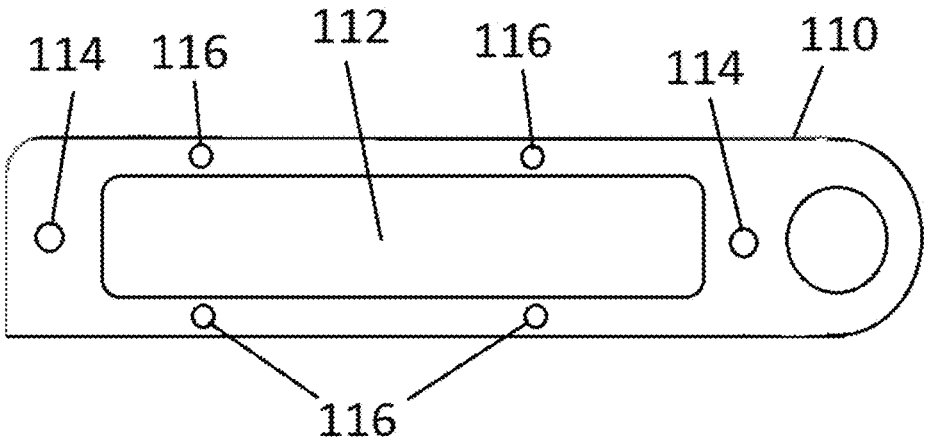
FIG. 10 front plan view of an alternative embodiment of an eductor of a static bilge pump in accordance with the principles of the invention.

FIGS. 9 and 10 show components of an alternative embodiment of the invention. FIG. 9 shows an eductor assembly 80 in accordance with the principles of the invention. An eductor inlet 86 may be in fluid communication with annular vacuum chamber 88 by means of eduction port 85. As with the embodiment of the invention shown in FIGS. 1-9, the eductor inlet 86 may be integral to a buttress 90. An annular vacuum chamber 58 may surround a cylindrical motive nozzle 92, which may be in fluid communication with aperture 94. When a boat is in motion, water may enter aperture 94 and may be ejected out of nozzle 92 and into eduction chamber 84. The movement of water through nozzle 92 and into eduction chamber 84 creates a vacuum within annular vacuum chamber 88. This in turn results in suction applied to eduction port 55 and through eductor inlet 86. Water and any other items in eduction chamber 84 may exit through exhaust port 98. Eductor assembly includes an integration block 100. Integration block 100 may include a conduit 102. A bolt hole 99 may be located just above integration block 110.

In FIG. 10 is shows an alternative embodiment of a body 110 in accordance with the principles of the invention. Body 110 includes an integration socket 112. Integration block 100 is sized to fit snugly with in integration socket well. Body 10 also includes bolt holes 114 for attaching the body 110 to a boat Hull. In this embodiment, body 110 also includes bolt holes 116. Bolt holes 116 may correspond to bolt holes 99 of the eductor assembly 80. Because bolt holes 116 may be located both above and below socket 112, and because the integration block 100 and socket 112 are bilaterally symmetric, and eductor assembly 80 may be integrated with a body 110. So that may be positioned either to the left or to the right of a boat hull's drain plug. It is not uncommon for various devices, such as trim tabs, sonar devices or other objects, to be installed close to a drain plug. If one or more devices are located adjacent to and left of a drain plug of a hole, it may not be possible to attach an eductor as shown in FIGS. 1-8 to the hull. The embodiment shown in FIGS. 9 and 10 allow for reversing and creating a mirror of the device as shown in FIG. 9. Making an eductor of the present invention ambidextrous, or capable of being flipped over to either side of a drain plug, facilitates an easier integration of the device into a boat hull.

Figure 11:
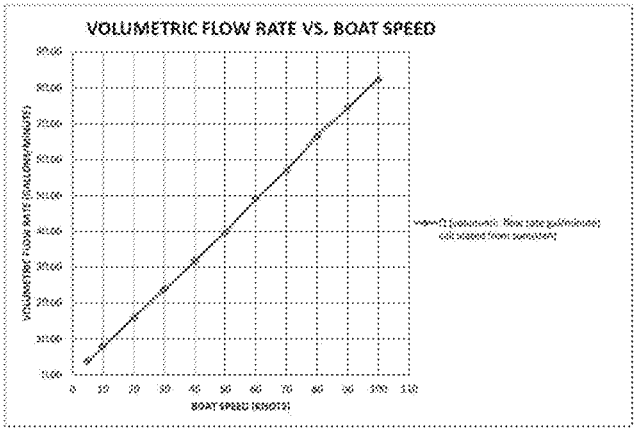
FIG. 11 is a graph showing the amount of gallons per minute a static bilge pump in accordance with the principles of the invention may be capable of pumping, as a function of speed of the boat.

FIG. 11 shows a graph of the amount of suction produced by the static bilge pump as a function of the speed of the boat to which it is attached. As may be seen, the static bilge pump, requiring no external power and having no moving parts, is capable of pumping 15 gallons per minute when a boat is traveling at only 20 miles per hour.

Figure 12:
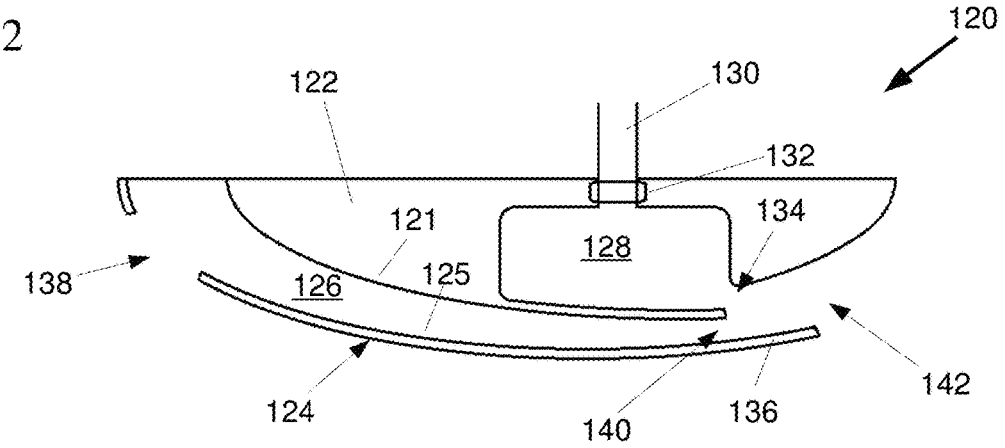
FIG. 12 is a cross section side view of an alternative embodiment of a static bilge pump in accordance with the principles of the invention.
Figure 13:
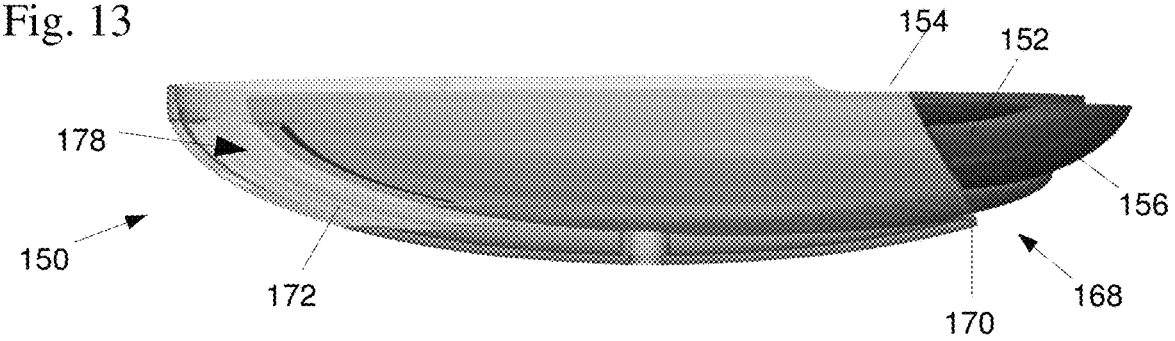
FIG. 13 is a side view of another alternative embodiment of a static bilge pump in accordance with the principles of the invention.
Figure 14:
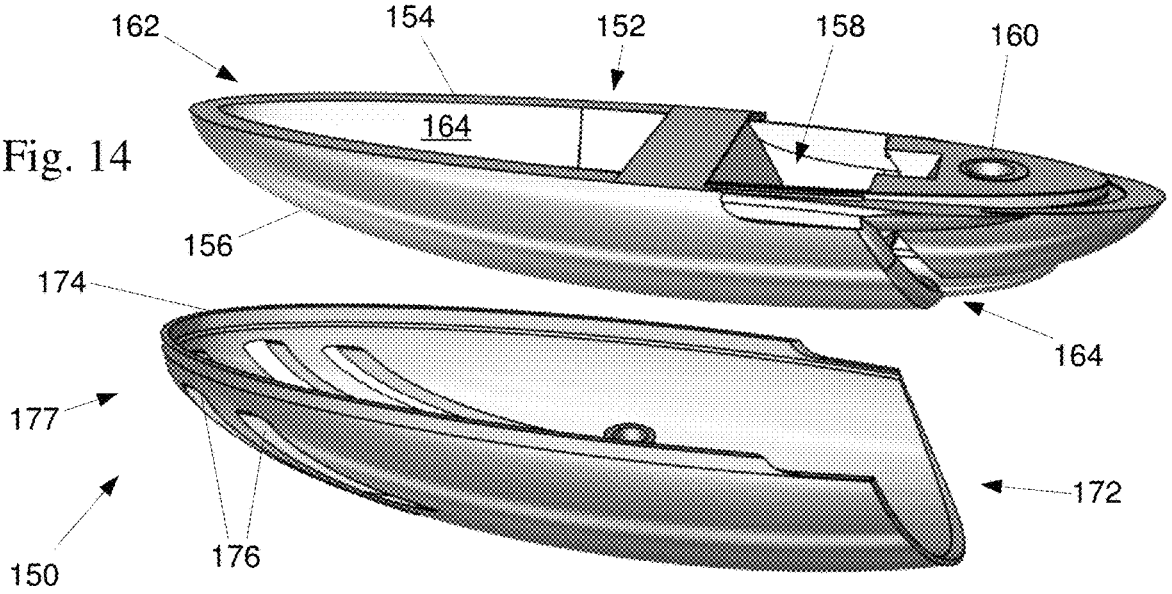
FIG. 14 is an exploded perspective view of another alternative embodiment of a static bilge pump in accordance with principles of the invention.

FIG. 12 shows a cross-section of an alternative embodiment of a static bilge pump 120 that may be attached to the bottom of a boat hull and automatically remove any liquid collected within the bilge of a hull. Static bilge pump 120 includes a body 122 and a shell 124 that fits over the body. The body 122 and shell 124 of the static bilge pump 120 define two chambers: a motive plenum 126 between the body 122 and the shell 124, and a suction chamber 128 housed entirely within the body 122.

The suction chamber 128 is in fluid communication with a suction inlet 130 that provide fluid communication to the bottom of the bilge of the boat hull to which the bilge pump 120 is affixed. A check valve 132 allows fluid flow in one direction only, from the suction inlet 130 into the suction chamber 128. This prevents fluid from flowing through the pump 120 and into the bilge of a hull. An ejector 134 permits fluid flow out of the suction chamber 128. Ejector 134 is located at the bottom rear region of the suction chamber.

The motive plenum 126 is defined by the convex bottom surface 121 of the body 122 and the concave inside wall 125 of the shell 124. The shell 124 also has a convex outer wall 136 and one or more motive inlets 138 that provide fluid communication between the motive plenum 126 and the exterior of the shell 124. When the bilge pump 120 is affixed to the bottom of a boat hull, the motive inlets 138 allow water to enter the motive plenum 126 with a force that correlates to the speed of the boat. As the plenum 126 extends from the front to the rear of the bilge pump 120, it tapers and decreases in size until it ends at a motive nozzle 140. Those skilled in the art will appreciate that the tapering size of the motive plenum 126 results in a water jet of increased speed and pressure, i.e. a motive fluid, to exit through the motive nozzle 140. As a result, the motive nozzle 140 applies negative pressure to the ejector 134, thereby causing suction to pull any liquid through the suction inlets and out of the bilge of a hull. The motive fluid and any fluid sucked through the suction chamber 128 and suction inlet 130 is expelled through the discharge outlet 142 of the static bilge pump 120.

Those skilled in the art will appreciate that many of the components of static bilge pump 120 may be comprised of a single component or multiple components. For example, there may be one or several motive inlets 138, one or several ejectors 134, and/or one or several suction inlets 130. The suction chamber 128 may be relatively large or may have the same cross-sectional area as the suction inlet 130 such that there is no well-defined suction chamber 128 and essentially only a suction inlet 130. The suction chamber 128 may also alternatively be substantially larger than shown here.

FIGS. 13-20 show an alternative embodiment of a static bilge pump 150 in accordance with the principles of the invention. The static bilge pump 150 is similar to the static bilge pump 120 shown in FIG. 12. A body 152 has a substantially flat, planar top 154 and a convex bottom 156. It includes an internal suction chamber 158 in fluid communication with a suction inlet 160. The front region 162 of the body 152 includes a hollow cavity 164 to reduce the amount of material required to manufacture the body 152. The body 152 includes two elongate curved ejectors 164 that provide fluid communication between the suction chamber 158 and the discharge outlet 168 at the rear edge 170 of the shell 172.

The shell 172 has an ellipsoidal shape with a flat, substantially planar top edge 174 that aligns with the top 154 of the body 152, both of which lie flush against the bottom of a boat hull. The shell 172 includes a plurality of the elongate motive inlets 176 at its front region 177. The motive plenum 178 formed between the body 152 and the shell 172 tapers as it moves from front to back and ends in a motive nozzle 168.

FIGS. 15-17 shows the body in more detail. In this embodiment, two ejectors 164 have curved rectangular openings. The suction inlet 160 is a conduit integrally formed within the body 152 and extends from the top 154 to an opening 161 in the rear wall 163 of the suction chamber, between the two ejectors 164. This embodiment also includes two longitudinal lateral strakes 169 above the ejectors 164. A central longitudinal strake 171 separates the two ejectors 164. The lateral strakes 169 and the central strake 171 improve fluid flow and minimize cavitation without compromising the negative pressure, or suction, generated at the ejectors 164 when the bilge pump 150 is exposed to longitudinal current. The ejectors 164 may optionally be divided into more than two separate ejectors. For example, the ejectors 164 could comprise a plurality of cylindrical or conical openings proximal and forward of the discharge outlet 168 formed at the trailing edge 170 of the shell 172.

A central bore 153 is positioned in the bottom 156 of the body 152 and allows a bolt or other fastener to affix the body 152 and/or shell 172 to the bottom of a boat hull. The body 152 may be formed from a single, unitary piece of material to improve strength. The forward cavity 164 primarily serves to conserve the amount of material required to form the body 152 and to minimize its weight. Thus, the cavity 164 is optional and the body 152 may have a forward region 162 that is a solid block, or may have a honeycomb or other framework inside it. Because the top 154 of the body 152 is configured to lie flush against the bottom of the hull of a boat, the presence, absence or configuration of the interior of the front 162 of the body 152 will not affect the fluid dynamics of the static bilge pump of the invention. When installing the bilge pump 150, it may be desirable to seal the top 154 of the body 152 to the whole using silicon or other material.

In this embodiment, there is no check valve incorporated into the suction inlet 160. As a result, to inhibit backwards flow of water, the suction inlet 160 should be connected to a water collecting device in the bilge by means of a conduit that is elevated above the water line between the bilge pump and the collector. Those skilled in the art will appreciate that this is necessary to prevent backward flow through the pump. This embodiment also utilizes the bottom of a boat hull for the top of the suction chamber in order to conserve material. Optionally, the suction chamber 158 may be formed completely internal to the body 152 such that it is not exposed on the top 154. This embodiment has an ellipsoidal, or hemi-ellipsoidal shape. This generally improves hydrodynamics. The static bilge pump may optionally have other configurations, but is generally preferred to have a hydrodynamically favorable shape.

FIGS. 18-20 show the shell 172 separate from the body 152 and in more detail. In this embodiment, the shell 172 has a hemi-ellipsoidal shape with a curved front region 177 and extending to an angled trailing edge 170. Six symmetrically arranged motive inlets 176 take the form of elongate longitudinal slits. By utilizing motive inlets 176 configured as an array of relatively narrow slits, large objects that could clog or damage the interior components of the bilge pump are prevented from entering the plenum.

The motive inlets 176 allow water to easily enter the motive plenum 178 where it is compressed as it moves aft and through the motive nozzle 168. In this embodiment, the shell 172 is formed from a single, unitary piece of material. A central shaft 180 is configured to align with and extend into the central bore 153 of the body 152. A bolt or other fastener may extend through the shaft 180 to hold the shell 172 and body 152.

Figure 21:
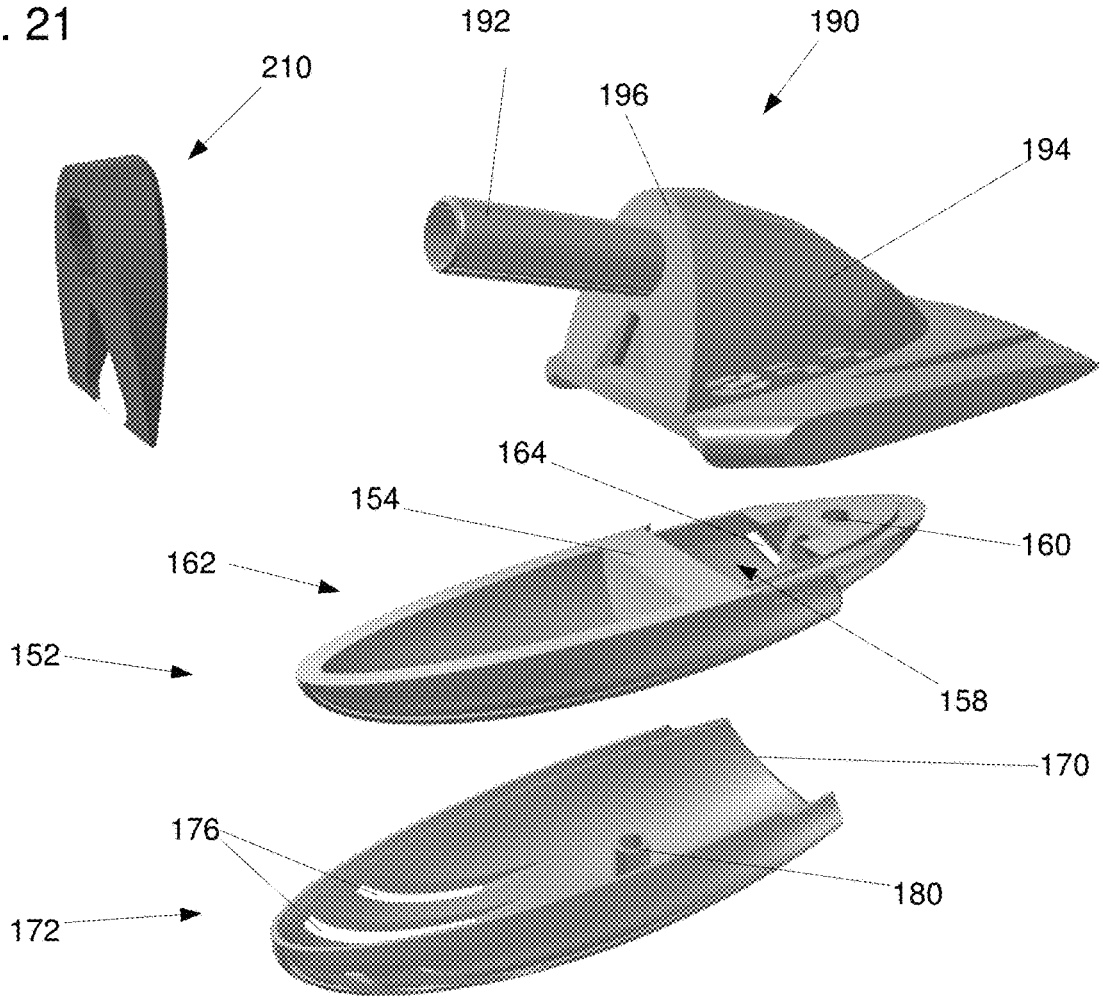
FIG. 21 is an exploded view of another alternative embodiment of a static bilge pump having a transom adapter and a wedge adapter in accordance with principles of the invention.

FIG. 21 shows the body 152 and the shell 172 of the static bilge pump 150 with two optional devices, a transom adapter 190 and a wedge adapter 210 that may be used to affix the static bilge pump 152 the aft end of the hull. The static bilge pump 150 has a suction inlet 160 accessible from the top 154 of the body 152. To affix the static bilge pump 150 to the bottom of a hull, a hole must be made in the bottom of the hull in order to access the suction inlet 160. The transom adapter 190 has an inlet tube 192 extending forward from its body 194 which may be affixed to the top 154 of the body 152, behind the front region 162 and above the suction chamber 158. The body 194 of the transom adapter 190 has a front faceplate 196 that is approximately 13° off the vertical to correspond to a 77° transom deadrise angle commonly found on a boat transoms. The wedge adapter 210 may be attached to the front faceplate 196 to accommodate a boat having a 90° transom dead rise angle.

Figure 22:
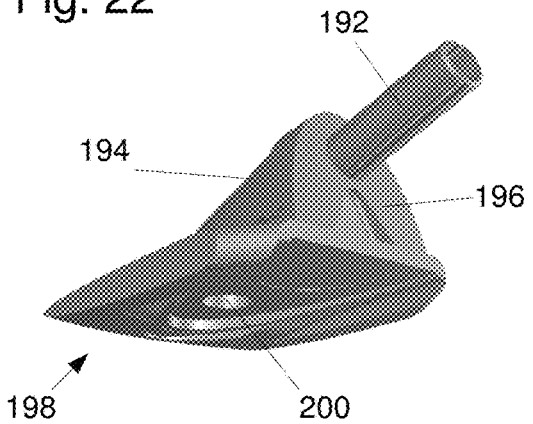
FIG. 22 is a perspective view of a transom adapter for a static bilge pump in accordance with the principles of the invention.
Figure 23:
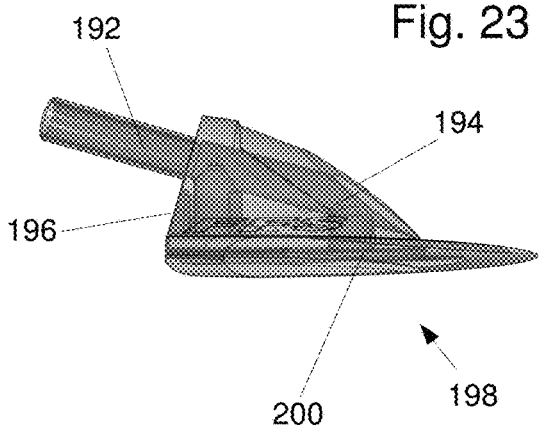
FIG. 23 is a cross-sectional view of a transom adapter for a static bilge pump in accordance with the principles of the invention.
Figure 24:
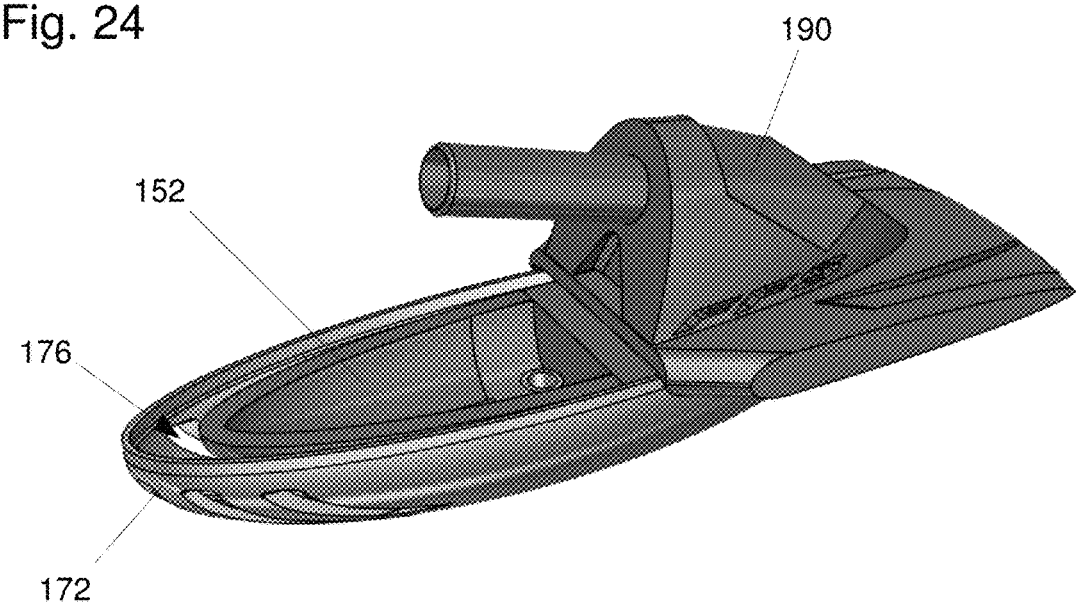
FIG. 24 is a perspective view of an assembled alternative embodiment of a static bilge pump with a transom adapter.

FIGS. 22 and 23 show the transom adapter 190 in more detail in accordance with principles of the invention. The bottom 198 of the body 194 of the transom adapter 190 is configured to lie flush against the top 154 of the body 152 of the static bilge pump 150. The bottom 198 of the body 194 has an outlet 200 that aligns with and is complementary to the suction inlet 160 of the body 152. The outlet 200 is in fluid communication with the inlet tube 192. If desired, a boat operator can attach the transom adapter 192 the static bilge pump 150 and inserts inlet tube 192 through a hole in the transom of the boat. FIG. 24 shows the transom adapter 192 affixed to the static bilge pump 150.

Figure 25:
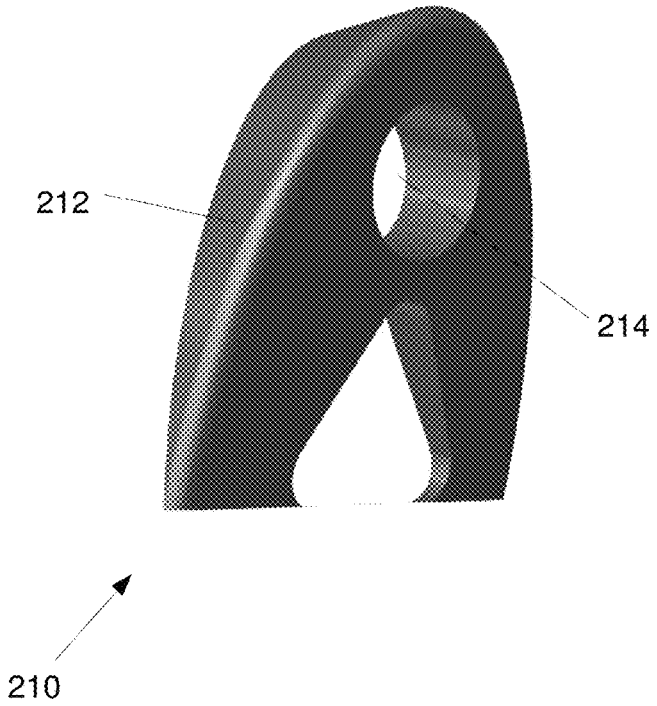
FIG. 25 is a perspective view of a wedge adapter for a static bilge pump in accordance with the principles of the invention.
Figure 26:
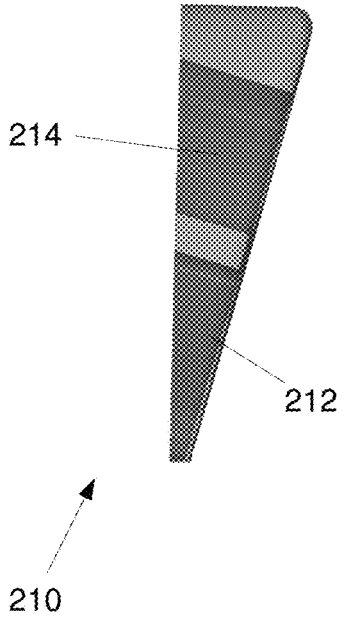
FIG. 26 is a cross-sectional side view of a wedge adapter for a static bilge pump in accordance with principles of the invention.
Figure 27:
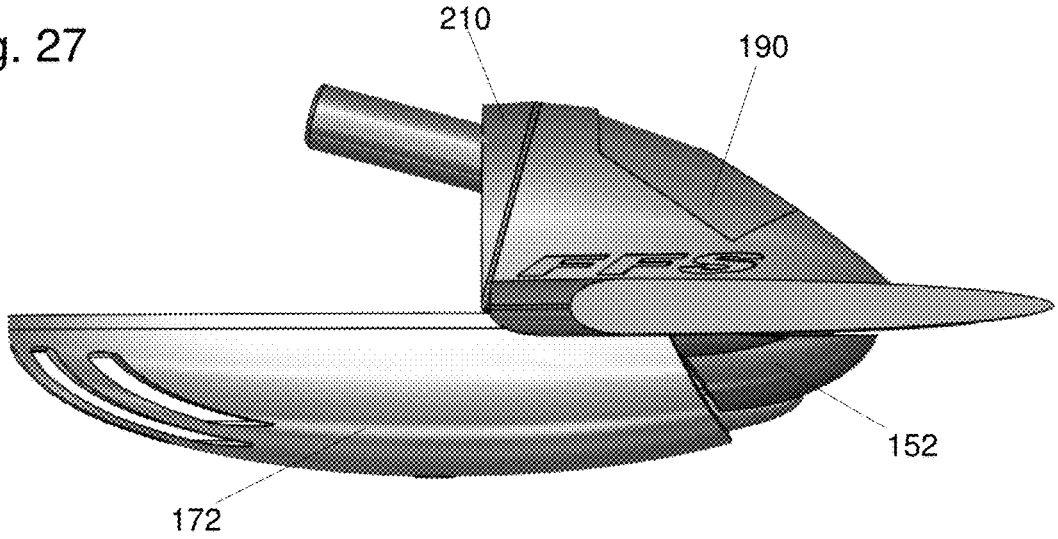
FIG. 27 is a side plan view of another alternative embodiment of an assembled static bilge pump with a transom adapter and a wedge adapter in accordance with the principles of the invention.

FIGS. 25 and 26 show the wedge adapter 210 in accordance with the principles of the invention. The wedge adapter 210 has a wedge shaped body 212 with a central bore 214 configured to snugly fit around the inlet tube 192 of the transom adapter 190. FIG. 27 shows both the transom adapter 190 and the wedge adapter 210 affixed to the static bilge pump 150.

Figure 28:
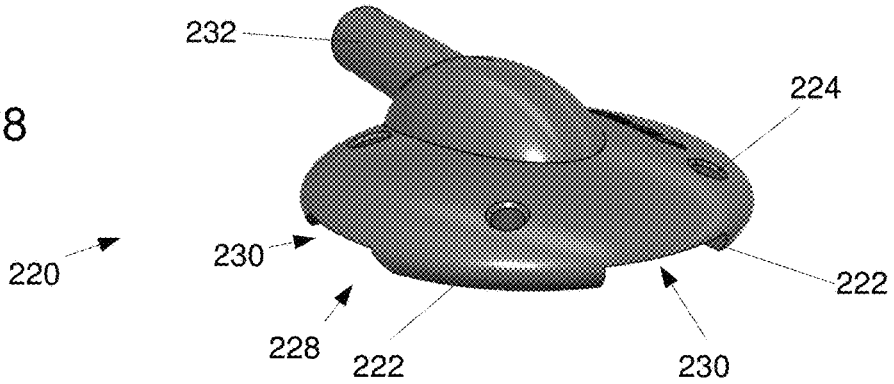
FIG. 28 is a perspective view of a fluid collector for a static bilge pump in accordance with the principles of the invention.
Figure 29:
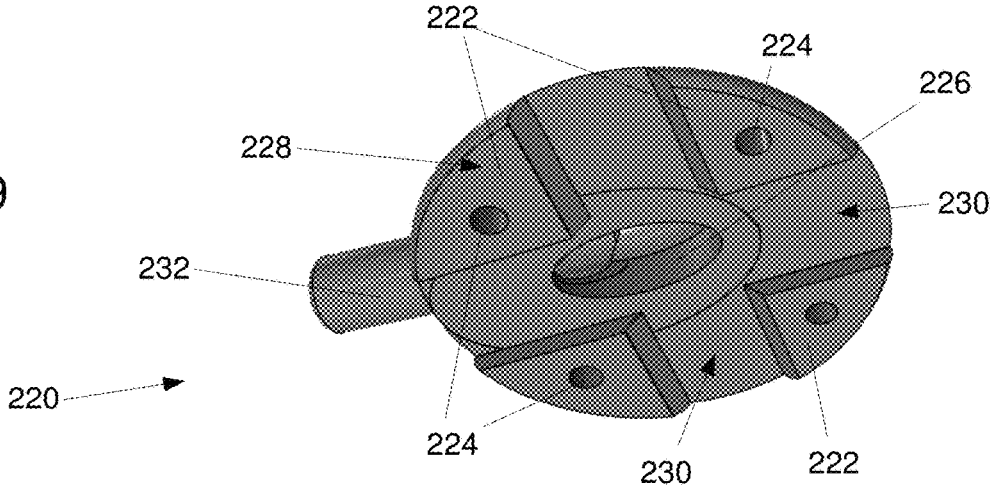
FIG. 29 is another perspective view of a fluid collector for a static bilge pump in accordance with principles of the invention.

FIGS. 28 and 29 show an exemplary fluid collector 220 in accordance with principles of the invention. The collector 220 includes four feet 222, each having a bore 224 to accommodate a bolt or other fastener. This allows the collector 220 to be fixedly attached to the floor of a boat's bilge, to a bulkhead or to another object within the bilge. A suction mouth 226 on the bottom 228 of the collector 220 is positioned between the feet 222. When the collector 220 is affixed to a flat surface, fluid accesses the suction mouth 226 by flowing through channels 230 between the feet 222. By limiting access to the suction mouth 226 through the narrow channels 230, larger objects are prevented from blocking or clogging fluid flow. The suction mouth to 26 is in fluid communication with the exhaust tube 232. The exhaust tube 232 may be placed in fluid communication with the suction inlet 160 of the static bilge pump 150 by means of a flexible tubing as is known in the art. Similarly, the exhaust tube 232 may be placed in fluid communication with the inlet tube 192 of the transom adapter 190.

The static bilge pump of the present invention, particularly the alternative embodiments shown in FIGS. 12-29, operate without any moving parts. When the static bilge pump is affixed to the bottom of a boat hull and the boat is moving in a forward direction, the water in which the boat floats serves as a motive fluid. Water enters the motive inlets in the front of the shell, filling the motive plenum. The motive plenum tapers along its longitudinal length, having a decreasing cross-sectional area as it moves aft. Thus the motive fluid in the motive plenum is ejected at increased pressure and speed from the motive nozzle proximal to the ejector(s) of the body. In the embodiments shown in FIGS. 12-29, the motive nozzle is curved having a U-shape roughly corresponding to the curved shape of the ejectors. This causes a Venturi effect, creating suction at the ejectors that pulls fluid in the suction chamber and suction inlet out through the discharge outlet along with the motive fluid. Those skilled in the art will appreciate that the U-shaped motive nozzles and ejectors enjoy a hydrodynamic shape. However, other configurations are possible. It may be desirable to have motive inlets consisting of several long slits to prevent solid objects from entering and clogging the motive plenum or motive nozzles. Optionally, the motive inlets may be comprised of a screen or grill for minimizing entry of clogging material.

Figure 30:
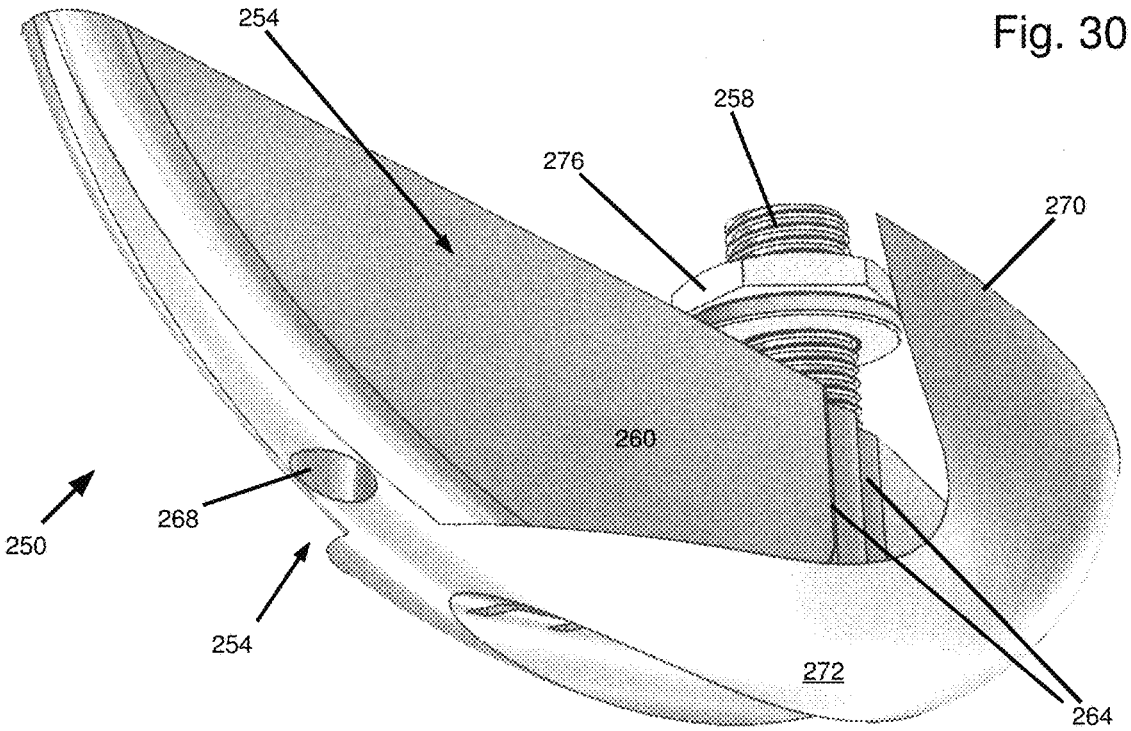
FIG. 30 is a bottom perspective view of another alternative embodiment of a static bilge pump in accordance with the principles of the invention.
Figure 31:
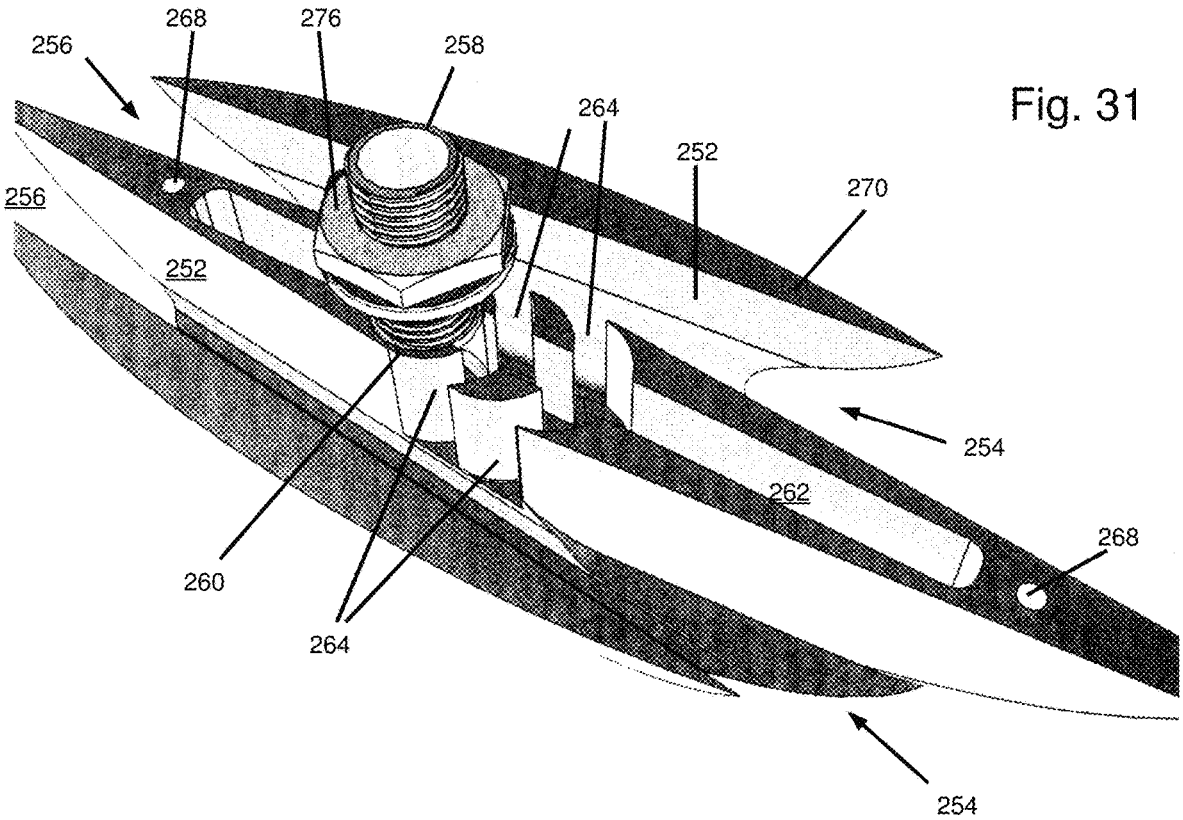
FIG. 31 is a top perspective view of another alternative embodiment of a static bilge pump in accordance with principles of the invention.
Figure 32:
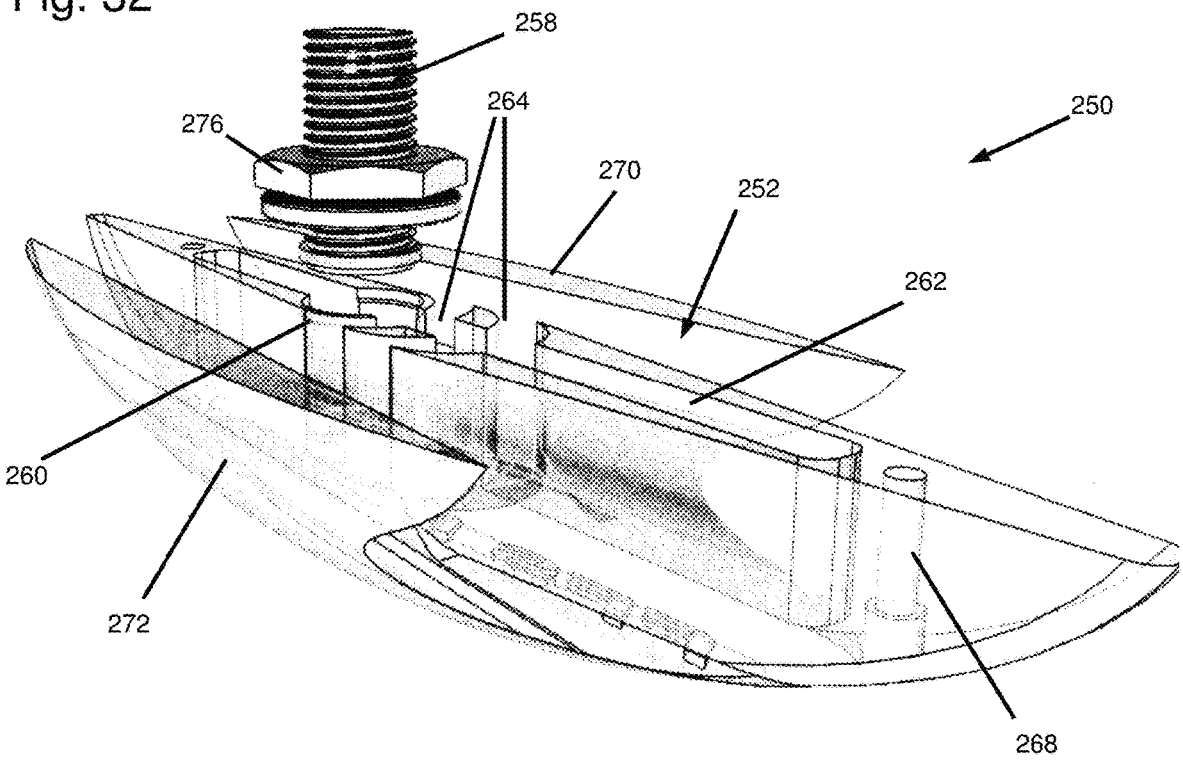
FIG. 32 is another top perspective view of another alternative embodiment of a static bilge pump in accordance with the principles of the invention.

FIGS. 30-32 show another alternative embodiment of a static bilge pump 250 in accordance with principles of the invention. Static bilge pump 250 has bilateral symmetry and includes two educator channels 252, each having a foreword inlet 254 and an outlet 256 in the back of the pump 250. A conduit 258 is affixed to a conduit socket 260 that puts it in fluid communication with a suction chamber 262. The suction chamber 262 is located in the middle of the pump 250 and has two nozzles 264 on each side that allows fluid in the suction chamber 262 to be pulled into the eductors 252 and ejected from the outlets 256. The static bilge pump 250 may include one or more bores 268 through which bolts may be inserted so that it may be affixed to the bottom of a boat. The top 270 of the pump 250 is planar and configured to lie flush against the bottom of a boat. The curved bottom 272 of the bilge pump 250 allows water to flow about the pump without pulling it off of the boat's hull. A bolt 276 may be used to tighten and secure the conduit 258 from inside the boat.

Figure 33:
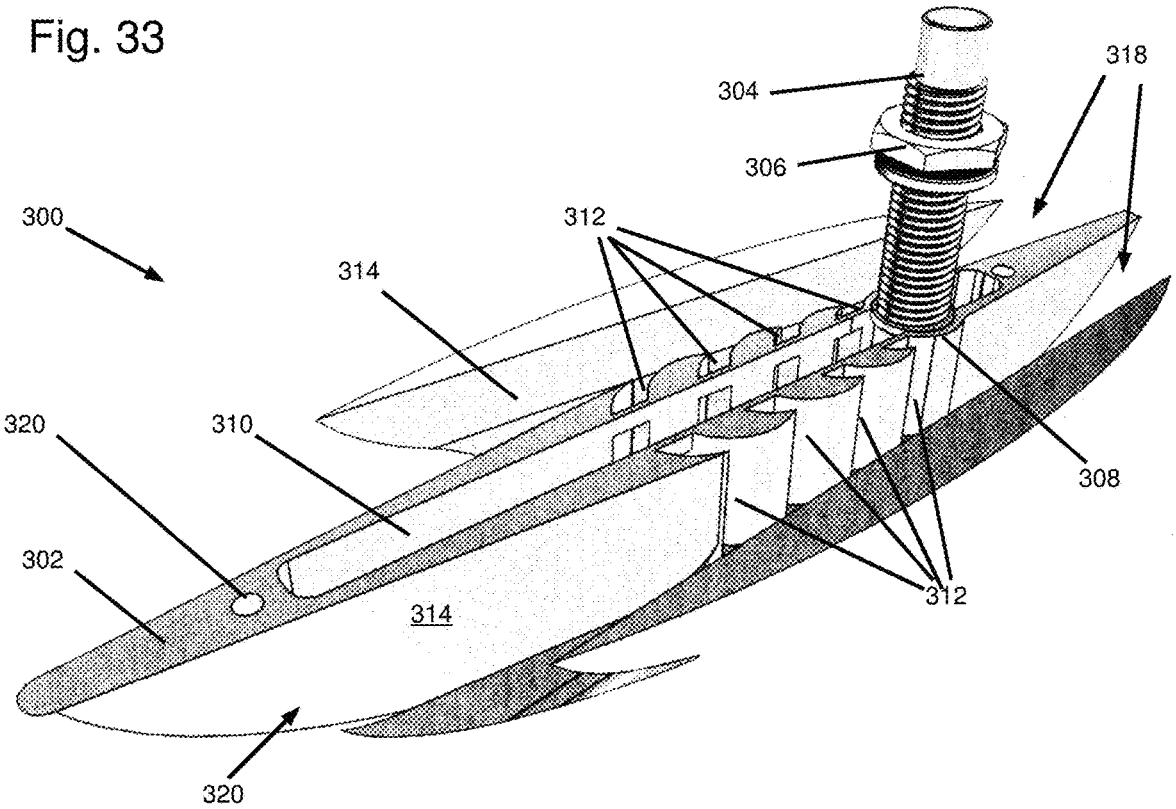
FIG. 33 is a top perspective view of another alternative embodiment of a static bilge pump in accordance with principles of the invention.
Figure 34:
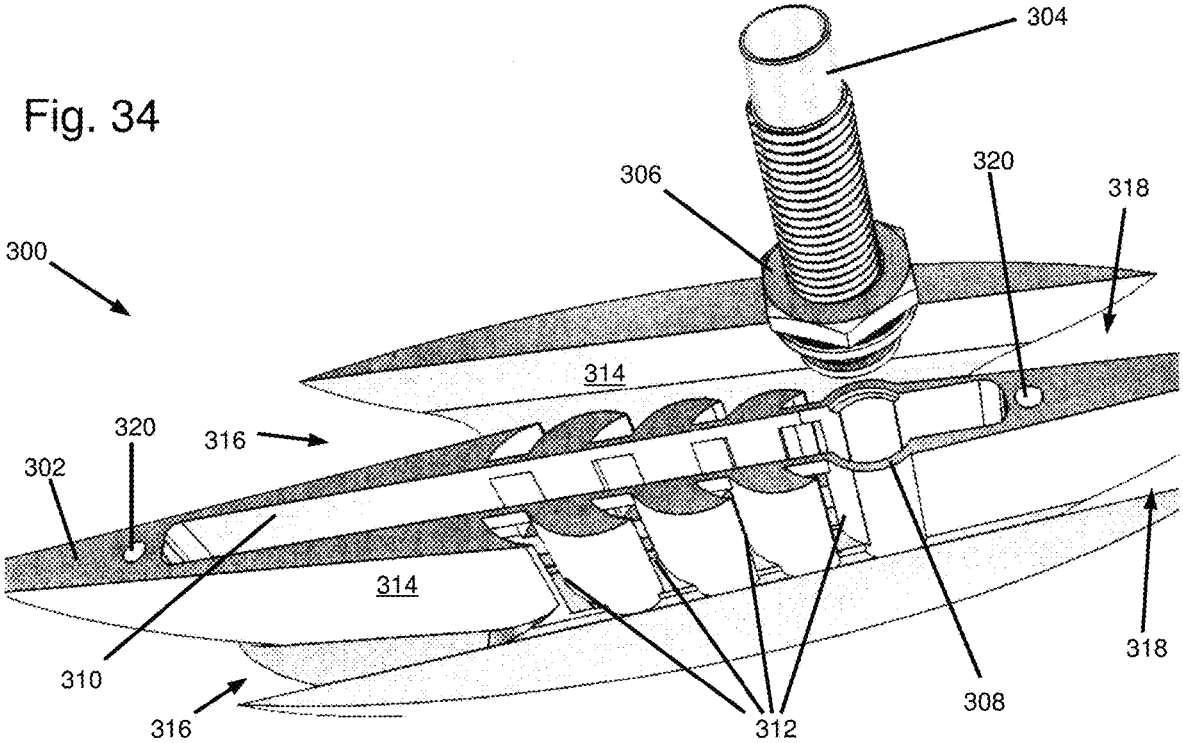
FIG. 34 is another top perspective view of another alternative embodiment of a static bilge pump in accordance with the principles of the invention.

FIGS. 33 and 34 show another alternative embodiment of a static bilge pump 300. The static bilge pump 300 is very similar to the static bilge pump 250, but has additional nozzles. The bilge pump 300 includes a planar top 302 configured to lie flush against the bottom of a boat hull. A conduit 304 extends through a hole in the boat hull and is affixed using bolt 306. The conduit 304 screws into a socket 308 providing fluid communication with the centrally located suction chamber 310. Each side of the suction chamber 310 has four nozzles 312 into the eductors 314. The eductors 314 have foreword inlets 316 through which water enters them. Water exits through the outlets 318 and sucks water out of the suction chamber 310. Two or more bores 320 may be used to bolts the bilge pump 300 to the bottom of a boat.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A static bilge pump comprising: a body having a convex bottom surface, a substantially flat, planar top that lies flush against a bottom of a hull of a boat moving in a forward direction, and two eductor channels each extending between a forward inlet in the body and an outlet at a back of the body; a suction chamber located between the two eductor channels, the suction chamber in fluid communication with a bilge of the boat hull through a conduit extending from the top of the body through the boat hull; a plurality of nozzles, each extending laterally from the suction chamber to one of the two eductor channels, thereby creating suction in the suction chamber when the boat is in motion; wherein the plurality of nozzles comprises four sets of opposing nozzles, such that each eductor channel is connected to the suction chamber by four nozzles, wherein the four sets of nozzles are located forward of a suction inlet to which the conduit is connected.

* * * * *